US005213070A

United States Patent [19]

Fujimoto

[11] Patent Number: 5,213,070

[45] Date of Patent: May 25, 1993

[54] TWO-CYCLE INTERNAL COMBUSTION ENGINE WITH SEQUENTIAL EXHAUST VALVE OPENINGS

[75] Inventor: Hiroaki Fujimoto, Hamamatsu, Japan

[73] Assignee: Sanshin Kogyo Kabushiki Kaisha, Japan

[21] Appl. No.: 788,871

[22] Filed: Nov. 7, 1991

[30] Foreign Application Priority Data

Nov. 7, 1990 [JP] Japan ..... 2-299726

[51] Int. Cl.[5] ..... F02B 37/00

[52] U.S. Cl. ..... 123/65 VC; 123/315

[58] Field of Search ..... 123/65 VC, 65 VD, 315, 123/311, 90.27, 65 PE

[56] References Cited

U.S. PATENT DOCUMENTS

| | | | |
|---|---|---|---|
| 4,875,455 | 10/1989 | Hashimoto et al. | 123/315 |
| 4,940,029 | 7/1990 | Kees | 123/65 VD |
| 4,964,375 | 10/1990 | Takeyama et al. | 123/315 |
| 5,000,133 | 3/1991 | Kawamura | 123/65 VC |
| 5,072,700 | 12/1991 | Kawamura | 123/315 |
| 5,129,369 | 7/1992 | Kawamura | 123/315 |

FOREIGN PATENT DOCUMENTS

| | | | |
|---|---|---|---|
| 55-151115 | 11/1980 | Japan | 123/315 |
| 63-55326 | 3/1988 | Japan | 123/315 |

*Primary Examiner*—David A. Okonsky
*Attorney, Agent, or Firm*—Bacon & Thomas

[57] ABSTRACT

This invention concerns a two-cycle internal combustion engine having a plurality of exhaust valves for each cylinder, and where during each exhaust valve control cycle, which includes a plurality of sequential combustion cycles of the engine, the exhaust valves open alternately.

5 Claims, 3 Drawing Sheets

TWO-CYCLE INTERNAL COMBUSTION ENGINE WITH SEQUENTIAL EXHAUST VALVE OPENINGS

BACKGROUND OF THE INVENTION

1. Field of the Invention

This invention concerns a two-cycle internal combustion engine and, more specifically, a valve arrangement for use in two-cycle internal combustion engines.

2. Discussion of the Prior Art

In two-cycle piston engines of the prior art, a scavenging port connects the crankcase, via a scavenging passage, to a cylinder in which a piston reciprocates while an exhaust passage is connected to an exhaust port located in the top of the combustion chamber. In such a system, an exhaust valve is seated in the exhaust port and opens at the required exhaust timing during each combustion cycle of the internal combustion engine.

In this type of two-cycle internal combustion engine, just after the combustion and expansion process, the new charge which has been preliminarily pressurized in the crankcase is introduced into the bottom of the combustion chamber through the scavenging port which is opened by the movement of the piston. When the piston begins its upward travel, exhaust gas at the top of the combustion chamber is driven out by the new charge at the bottom of the chamber. Then the new charge in the chamber is compressed and undergoes the combustion and expansion process. Each turn of the crankshaft completes one combustion cycle.

This arrangement permits the new charge which is introduced into the bottom of the combustion chamber to remain as a layer separate from the burned combustion products gas at the top of the chamber, so the latter can be expelled as exhaust. By preventing the new charge from escaping with the exhaust, the fuel efficiency of the engine is enhanced and hydrocarbon emissions are reduced.

However, in the prior art, when the exhaust valve opens during each combustion cycle of the engine, the exhaust valve projects into the center of the combustion chamber, not only causing it to be exposed to high temperature combustion gases, but also causing the exhaust to flow around it. Because of this, a large amount of heat is transmitted to the exhaust valve, which exceed the amount of heat that can be dissipated through the valve seat, whereby the temperature of the exhaust valve could rise to an unacceptable level. Since there is a combustion cycle for each revolution of the engine in a two-cycle internal combustion engine, the above described heat load on exhaust valves is substantial.

Therefore, when such prior art two-cycle internal combustion engines are operated at high output levels such as in outboard motors, the heat load on the exhaust valve can become so high as to cause abnormal combustion or damage to the valve itself, and detract from the longevity and reliability of the engine.

SUMMARY OF THE INVENTION

This invention concerns a two-cycle internal combustion engine having scavenging port connecting the crankcase to each cylinder via a scavenging passage opening on the cylinder surface and an exhaust port system opening into each cylinder at the top of the combustion chamber. The exhaust port system comprises a plurality of exhaust valves associated with each cylinder, each of which during each exhaust valve control cycle (which will be composed of a plurality of sequential combustion cycles of the engine) opens alternately or in sequence.

According to this invention, not all the exhaust valves of each cylinder open during each combustion cycle. Therefore, even when the engine is in the process of exhausting gases, there are times when individual exhaust valves are closed and not exposed to high temperature combustion gases, etc. This lessens the degree to which heat can build up and improves the ability of the exhaust valves to dissipate heat through their respective valve seats.

DETAILED DESCRIPTION OF THE PREFERRED EMBODIMENT

Figure 5:
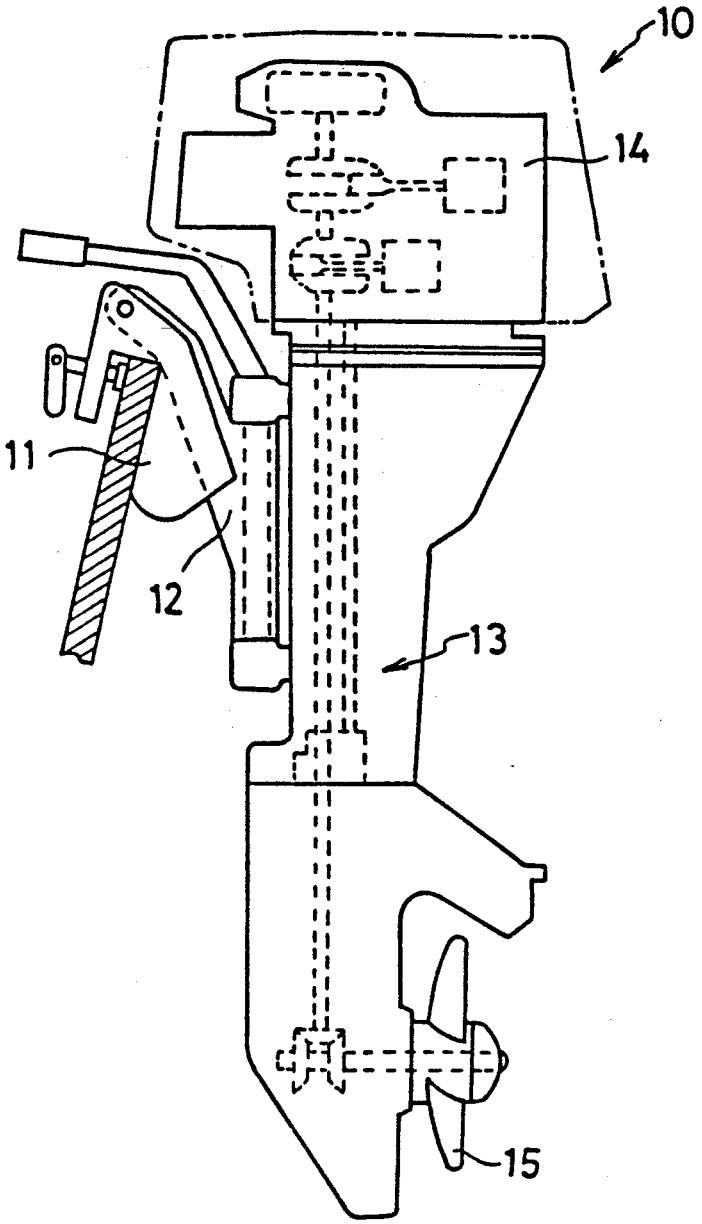
FIG. 5 is an overall view of an outboard engine incorporating the two-cycle internal combustion engine of the present invention.

Initially, reference is made to FIG. 5 which depicts an outboard motor incorporating the internal combustion engine of the present invention. As shown in FIG. 5, the outboard motor 10 is connected to a transom of a boat by means of a clamp bracket 11, while swivel bracket 12 rotatably supports the engine and the swivel bracket 12 can be tilted by means of the clamp bracket 11. The propulsion unit 13 can be steered by means of the swivel bracket 12. The propulsion unit 13 of outboard motor 10 has an internal combustion engine 14 located near its top, and the output of this internal combustion engine spins the propeller 15.

Figure 1:
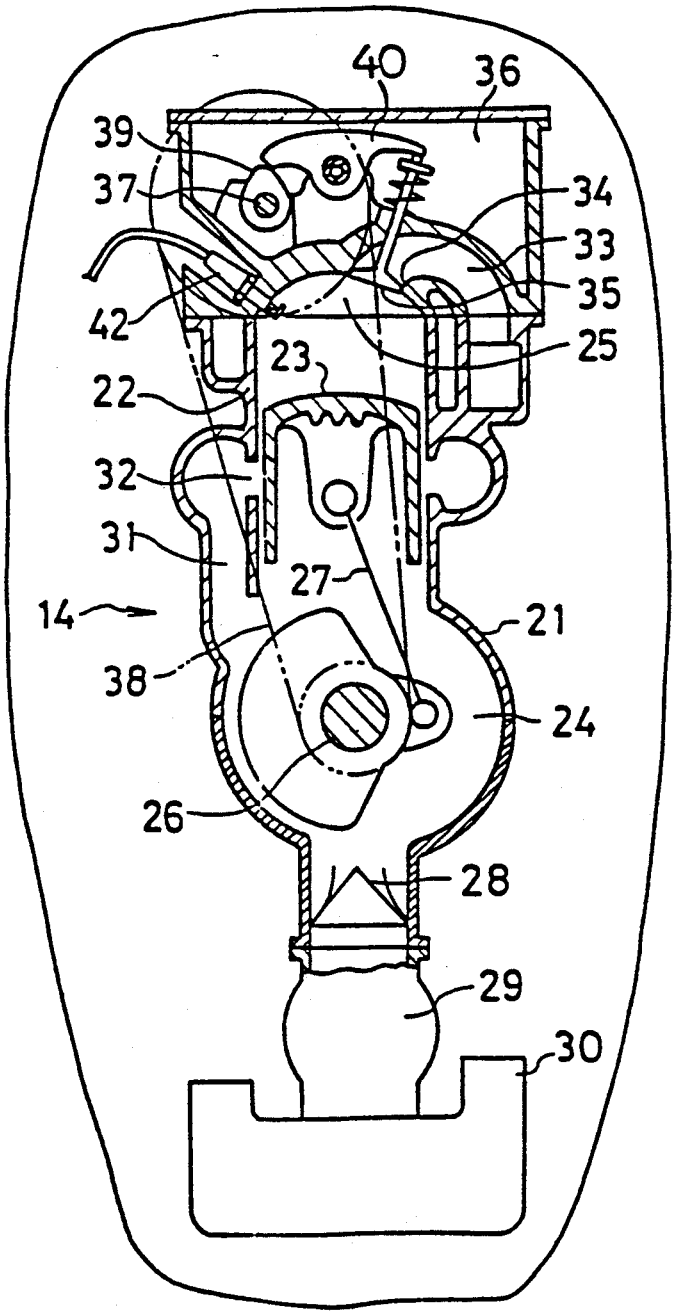
FIG. 1 shows a two-cycle internal combustion engine according to the invention.

As shown in FIG. 1, internal combustion engine 14 is a two-cycle internal combustion engine and includes a horizontally positioned cylinder 22 in the engine housing 21 which contains a piston 23. A crankcase 24 is located on one side of the piston 23 and a combustion chamber 25 at the other side. Mounted within crankcase 24 is a vertically mounted crankshaft 26. Crankshaft 26 is connected to piston 23 by means of a connecting rod 27 for reciprocating piston 23 in response to rotation of crankshaft 26 as is known in the art.

A fresh charge (air and vaporized fuel) is drawn into crankcase 24 of the internal combustion engine 14 via reed valve 28, carburetor 29 and the air intake duct 30.

The internal combustion engine 14 has a scavenging passage 31 which connects the crankcase 24 with a scavenging port 32 opening into cylinder 22 within which piston 23 reciprocates. Actually, various scavenging ports 32 are located around the central axis of the cylinder 22. In the alternative, scavenging port 32 may open continuously over 360 degrees.

Figure 4:
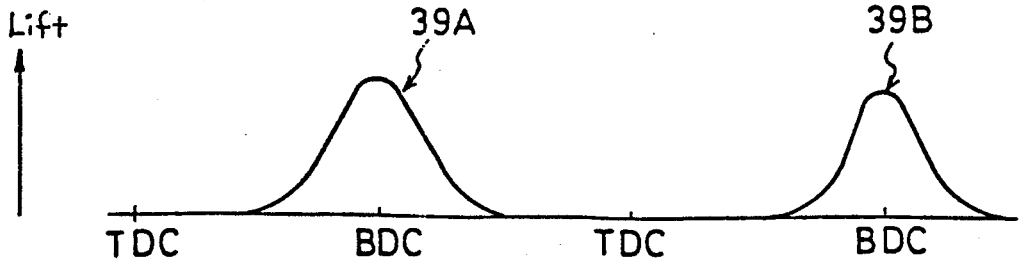
FIG. 4 is a graph of the exhaust valve lift.

Internal combustion engine 14 includes a system of exhaust ports 34 which are located at a top portion of each combustion chamber 25 associated with each cylinder 22. Exhaust ports 34 are equipped with exhaust valves 35 which open and close according to a predetermined exhaust timing in each combustion cycle (see FIG. 4). Internal combustion engine 14 also has a cam shaft 37 located within cam chamber 36. Cam shaft 37 is connected through a belt 38 to crankshaft 26 so as to rotate in unison therewith. Affixed to camshaft 37 is a cam 39 which acts upon a rocker arm 40 whereby rotation of camshaft 37 causes rocker arm 40 to oscillate by means of cam 39. Movement of rocker arm 40 causes exhaust valves 35 to open and close with respect to valve seat 41. In addition, a spark plug 42, located at the top of internal combustion engine 14, extends into combustion chamber 25.

In the scavenging/exhaust cycles which follow the combustion and expansion process in a two-cycle internal combustion engine 14, a compressed charge in crankcase 24 is sent into the lower part of combustion chamber 25 through scavenging port 32 which is opened by piston 23 when piston 23 slides in cylinder 22 to its bottom position. In addition, exhaust port 34 at the top of combustion chamber 25 is opened by means of exhaust valve 35 and combustion product gases which were in the upper part of the combustion chamber 25 are, with the rise of piston 23, driven out by the fresh charge just above piston 23. Then, once the exhaust process is complete, the charge in combustion chamber 25 is compressed, ignited and expanded to complete one cycle within one turn of crankshaft 26, or two reciprocal strokes of piston 23.

Figure 2:
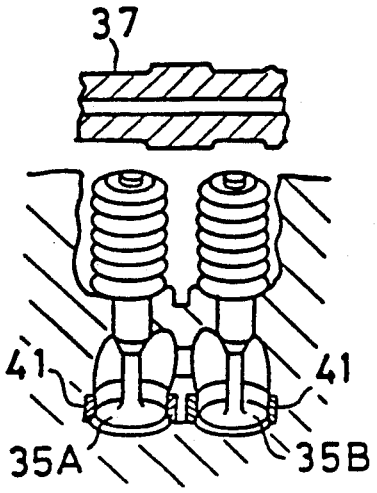
FIG. 2 is a side view of the internal combustion engine of FIG. 1 showing the alignment of the exhaust valves.
Figure 3:
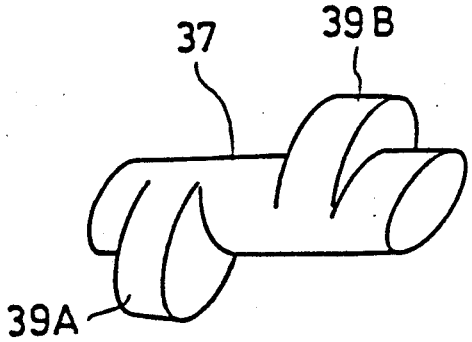
FIG. 3 is a perspective view of the cam used in the two-cycle internal combustion engine of the present invention.

Actually, as shown by FIG. 2, the internal combustion engine 14 in accordance with a preferred embodiment this invention is equipped with two exhaust valves 35A and 35B per each cylinder 22. One control cycle of the internal combustion engine 14 is composed of two sequential combustion cycles with the opening of exhaust valves 35A and 35B alternating with each combustion cycle. To accomplish this, cam shaft 37 turns at only one-half the rate of the crankshaft 26 through belt 38. The two exhaust valves 35A and 35B are opened and closed respectively by two cams 39A and 39B which are both mounted on camshaft 37 and phased 180 degrees apart from each other (see FIGS. 3 and 4).

In operation, exhaust valves 35A and 35B do not both open during each combustion cycle. Accordingly, in the exhaust process for combustion engine 14, one of the exhaust valves 35A and 35B remains closed, so as to not be exposed to high temperature combustion gases along with its corresponding valve seat 41.

Thus, when used in two-cycle engines, which are subjected to much higher heat loads than 4 cycle engines, this arrangement assures longevity and reliability of the internal combustion engine 14, even when this engine is run as an outboard motor at high speeds for extended periods.

As a separate example, it is possible to use three exhaust valves, A, B and C, per cylinder and have one control cycle for the valves which extends over three sequential combustion cycles. Exhaust valve A would be opened during the first combustion cycle, exhaust valve B would open during the second combustion cycle, and exhaust valve C would open during the third combustion cycle to complete one control cycle. In addition, it would be possible during this control cycle to allow two valves, A and B, for example, to open during the first combustion cycle and one valve, C, to open during the second combustion cycle.

It should be noted that various charges and/or modifications may be made to the invention as described above without departing from the spirit of the invention which is, in general, the establishment of exhaust valve arrangements for use in two cycle internal combustion engines to inhibit associated temperature elevations in exhaust valves. The invention should therefore only be limited by the scope of the following claims.

I claim:

1. A two-cycle internal combustion engine comprising:

a combustion chamber including a cylinder composed of a side portion and first and second end portions;

a crankcase opening up into said second end portion of said cylinder;

a piston slidable mounted for reciprocal motion within said cylinder;

crankshaft means mounted in said crankcase and adapted to be rotated by reciprocal motion of said piston in said cylinder;

charge intake and delivery means including a scavenging passage for delivering a charge to said combustion chamber, said scavenging passage terminating in a scavenging port which opens into said side portion of said cylinder;

exhaust outlet means located in said first end portion of said cylinder, said exhaust outlet means further including a plurality of exhaust ports and a plurality of exhaust valves, each of said exhaust valves being seated in a respective one of said exhaust ports;

means for opening the exhaust valves individually in a non-overlapping manner consecutively over sequential combustion cycles, each combustion cycle including a charge intake, compression, ignition, expansion and exhaust event.

2. An engine as claimed in claim 1, wherein two exhaust ports and exhaust valves are provided for each said cylinder, and said means for opening each exhaust valve comprises an exhaust camshaft driven at half engine speed and having a pair of valve opening lobes spaced 180° apart thereon, each lobe actuating a respective exhaust valve.

3. In an internal combustion engine including a piston reciprocally mounted in a cylinder to define a variable volume combustion chamber at one end of the cylinder, charge intake means for admitting a charge to the combustion chamber and an exhaust valve means for discharging combustion products from the combustion chamber, the improvement comprising:

said exhaust valve means comprising a plurality of exhaust valves, and means for opening the exhaust valves individually in a non-overlapping manner consecutively over sequential combustion cycles, each combustion cycle including a charge intake, compression, ignition, expansion and exhaust event.

4. The improvement in an internal combustion engine as claimed in claim 3, wherein said engine is a two-cycle engine wherein each combustion cycle occurs during two reciprocal strokes of the piston.

5. A method of exhausting combustion products from the combustion chamber of a two-cycle piston internal combustion engine operating on a combustion cycle including a charge intake, compression, ignition, expansion, combustion and exhaust event per each two reciprocal strokes of the engine piston, comprising:

providing multiple normally closed exhaust valves for each combustion chamber;

operating the exhaust valves so they individually open in a non-overlapping manner consecutively over sequential combustion cycles of the engine.

* * * * *